United States Patent [19]

Dave

[11] 4,105,739

[45] Aug. 8, 1978

[54] CONSTRUCTIONAL ELEMENTS OF CONCRETE

[75] Inventor: Nalinkumar Jayantilal Dave, Rochdale, England

[73] Assignee: University of Salford, England

[21] Appl. No.: 711,283

[22] Filed: Aug. 3, 1976

Related U.S. Application Data

[63] Continuation-in-part of Ser. No. 487,291, Jul. 10, 1974, abandoned.

[51] Int. Cl.[2] ..... B28B 1/16

[52] U.S. Cl. ..... 264/256; 52/659; 52/724; 264/228; 264/267; 264/DIG. 57

[58] Field of Search ..... 264/256, 228, DIG. 57, 264/267; 52/223 R, 659, 723, 724, 725

[56] References Cited

U.S. PATENT DOCUMENTS

| | | | |
|---|---|---|---|
| 2,421,721 | 6/1947 | Smith | 52/612 |
| 3,271,917 | 9/1966 | Rubenstein | 52/724 X |
| 3,808,085 | 4/1974 | Givens | 52/659 X |
| 3,852,930 | 12/1974 | Naaman | 52/659 X |

FOREIGN PATENT DOCUMENTS

| | | | |
|---|---|---|---|
| 559,136 | 6/1958 | Canada | 52/223 R |

*Primary Examiner*—Thomas P. Pavelko

[57] ABSTRACT

A structural element of concrete is selectively reinforced over that part of the surface where, when the element is loaded, tensile stresses can occur which might exceed the tensile strength of the concrete. The reinforcement comprises a relatively thin, integral external layer preformed from a cement composition reinforced with fibres disposed in a random two-dimensional distribution essentially parallel to the surface of the layer, the latter extending over the whole area of said part of the surface liable to tensile stress.

10 Claims, 31 Drawing Figures

25
20
15
10
5
0
5
10
15
LOAD (KN)
DEFLECTION (mm)
52
51

W
1000
1000
1000

41
51
41

LIMITING DEFLECTION L/250

43
42
44
54
53
LIMITING DEFLECTION L/250
LOAD (KN)
DEFLECTION (mm)
0
2
4
6
8
10
12
14
16
18
20
22
24

W
W/2
W/2
W/2
W/2
9/7
9/7
9/7 a
b
c
d
1
2
3

WORKING LOAD
LIMITING DEFLECTION
SPAN/250
DEFLECTION (mm)
LOAD (KN)
5
10
15
20
25
10
20
30

W
W/2
W/2
W/2
W/2
1500
4500
1500 b
c
d1
12 b
c
11

12
11
WORKING LOAD
LOAD (kN)
30
20
10
0
5
10
15
20
25
DEFLECTION (mm)

W
W/2
917
31
32
33
34
35
LIMITING DEFLECTION L/250
DEFLECTION (mm)
LOAD (KN)
0
5
10
15
20
25
10
20
30

| BEAM No. | CRACKING LOAD KN | | ULTIMATE LOAD KN |
|---|---|---|---|
| | CONCRETE | asb cement | |
| 31 | 6 | — | 44·0 |
| 32 | 22 | 32 | 42·1 |
| 33 | 22 | 44 | 46·5 |
| 34 | 42 | 40 | 46·8 |
| 35 | — | 38 | 50·3 |

CONSTRUCTIONAL ELEMENTS OF CONCRETE

The present application is a continuation-in-part of my co-pending application Ser. No. 487291, filed on July 10th 1974 now abandoned.

This invention is concerned with load-bearing structural members in the form of slabs or beams of reinforced concrete, parts of which in use are likely to be subject to tensile stresses.

BACKGROUND TO THE INVENTION

Concrete has poor physical properties when subject to tensile stress and it is therefore common practice to reinforce it with steel wires and/or rods in order to enhance its performance in load bearing applications where tensile stress is likely to occur. However, the transfer of tensile stress to the reinforcement is never complete and because of the low tensile strength and low extensibility of concrete compared to that of the steel reinforcement, cracking occurs in the concrete, always from that side, face or edge of the member where the tensile stress is developed.

It is this phenomenon of stress cracking which primarily determines the practical load-bearing capability of a given reinforced concrete structural member, because the cracks propagate through the member from that part of it which is subject to the tensile stress, not only weakening the member but more significantly allowing air and moisture to enter and gain access to the reinforcement. Furthermore, the cracks result in increased deflection under load, which in turn increases the tensile strain developed in the concrete and in consequence, the rate of crack development and propagation increases. Long before failure of the member occurs, its load-bearing capability is significantly impaired.

The historical solution to this problem lies in calculated over-design. Faced with a given, safe working load, the design process includes the step of calculating the theoretical ultimate load strength necessary to provide this safe working load. Then the designer must take into account the effects of deflection and stress cracking. Given a maximum allowable deflection under the safe working load, the permissible extent of stress cracking and crack propagation must then be allowed for. In practice this is done by choosing a much bigger section, possibly, with a higher ultimate load strength. A structural member designed on this basis is larger, heavier and uses more concrete than would otherwise be necessary. It may also have the incidental effect of reducing headroom, or increasing the overall height/size of a building or other structure.

Pre-stressing the structural element has its own problems. It is expensive and can be difficult to apply in a controlled manner on a building site. Occasionally it can also be dangerous.

OBJECTS OF THE PRESENT INVENTION

It is an object of the present invention to provide a load-bearing structural member of reinforced concrete with a significantly enhanced resistance to cracking under tensile stress. It is further object of the invention to provide a load-bearing structural member of reinforced concrete wherein the theoretical utlimate load strength of the member more closely corresponds to the safe working load thereof under given conditions of allowable deflection and permissible extent of crack incidence, always allowing for an appropriate margin of safety. Alternatively, it is an object of the present invention to provide a load-bearing structural member of reinforced concrete wherein the safe working load is significantly higher for the same conditions of allowable deflection and permissible crack incidence then would be the case for a prior art structural member of the same material and dimensions.

BRIEF DESCRIPTION OF THE INVENTION

The invention essentially resides in the discovery that by providing that part of the surface of a reinforced concrete structural member that in use may be subjected to tensile stresses which might exceed the tensile strength of the concrete, with relatively thin integral, preformed, and consolidated external reinforcing layer of a cement composition reinforced with fibres disposed in a random, two-dimensional distribution parallel to the surface of the layer, a considerable reduction in the incidence of tensile stress cracking can be achieved for a given working load. Furthermore, the deflection under load is also reduced. Significant reductions in both cracking and deflection can be accomplished with the aid of a surprisingly thin external reinforcing layer of fibre-reinforced cement composition which does not itself contain any structural steelwork at all. Because cracking and deflection are reduced, the design objectives referred to earlier can be achieved.

The thickness of the reinforcing layer is preferably significantly less than 10% of the total thickness of the element, measured in a direction normal to the surface with which it is integral. In the case of a reinforced concrete beam, the thickness of the layer can be significantly less than 5% of the total depth of the beam whilst still giving satisfactory results.

It is believed that the reason for the apparently disproportionate effect of the thin external reinforcing layer or layers of this invention lies in the greatly enhanced tensile properties and the appreciably greater extensibility of the preformed and consolidated layer as opposed to the concrete with which it is integral. Particularly preferred materials for the layer are asbestoscement and glass fiber reinforced cement another high modulus fibre may also be used. In the case of asbestoscement the typical ultimate tensile strength is in the range 16–20 $N/mm^2$ compared to 1.5–3.5 for concrete alone. Likewise the tensile strain at breaking for asbestos cement is of the order of 600–1600 ($x10^{-6}$) whereas the same strain range for concrete is only 100–200 ($x10^{-6}$). Glass fiber reinforced cement is similarly better than concrete alone as regards its tensile strength and extensibility.

A significant advantage of cement as the matrix material for the fibers lies in the fact that it is entirely compatible with the rest of the structural member and the bond between the layer and the structural member is extremely strong indeed. It is essential to preform and consolidate the reinforcing layer so as to obtain both good homogeneity and high density, much higher than can be accomplished by attempting to cast both layer and element by on-site casting processes. This is especially true of asbestos-cement.

DISPOSITION OF THE REINFORCING LAYER

The reinforcing layer may be applied to the whole of the surface of the structural member where tensile stresses exceeding the tensile strength of the concrete may occur. This is appropriate for structural members intended for roofing or flooring purposes.

The reinforcing layer may also extend to cover the sides of the member up to the neutral axis thereof (referring to the line along which the transition from tensile to compressive stress lies when the beam is loaded. The reinforcing layer never extends to those surface areas of the sides of the member where tensile stresses are not developed. However, where a plurality of surface areas liable to tensile stresses are present, they may be individually and selectively reinforced, whether or not they are part of the same surface.

The plurality of areas may all be disposed on said surface but according to one preferred aspect of the invention the face opposing said surface is also provided with an integral, external reinforcing layer of fibre-reinforced cement composition extending over the full width of said opposing surface and over at least that part of the length of said opposing surface where tensile stresses under working load might exceed the tensile strength of the concrete. In the same way a plurality of areas of the opposing face may be reinforced with an external layer of fibre-reinforced cement composition, said areas being provided where design requirements induce stresses under working load which may exceed the tensile strength of the concrete. For example, in the case of a simple beam supported at its two ends and carrying a uniform, vertically applied load, it is required to provide the reinforcing layer in such a way as to extend over at least the central portion of the underside (referring to its attitude in use) of the beam. Should the beam, however, be provided with a further central support, then the stresses applied under load would require the provision of reinforcing a layer of fibre reinforced cement extending over at least the portions of the underside (referring to its attitude in use) of the beam located between the central and side supports and also extending over the opposite top surface of the beam extending either side of the central support. Obviously, the reinforcing layer can extend where necessary over the whole length of the underside of the beam and/or of the opposite top surface.

The reinforcing layer can, for example, conveniently be provided by preformed and consolidated asbestos cement composition sheets thereafter cast integrally with the reinforced concrete and these sheets can advantageously also serve to provide at least part of the form-work for the casting operation. The distribution of the fibres in such sheets is substantially parallel to the major plane of the sheet.

The improvements in the performance characteristics of the member, are related to the thickness of the reinforcing layer and also to the characteristics of the material of the layer. As mentioned earlier, the layer preferably constitutes significantly less than 10% of the total thickness of the element with which it is integral. However, practical considerations set limits on the thinness of the layer and in the case of asbestos-cement, layers of less than 3mm thickness are not normally made. Accordingly the reinforcing layer will usually constitute only about 2 to 6% of the total thickness of the element with which it is integral. The invention lends itself both to the factory production of pre-cast reinforced concrete structural members and to on-site production of in situ cast members, subject to the usual considerations such as dimensions of the members. Obviously, the dimensions of the reinforcing layer of fibrous cement composition are relative, larger structural members being more likely to need thicker layers, but the invention is generally applicable to constructional elements of reinforced concrete where tensile stress may be encountered in use. However, in relation to the thickness dimensions of the member with which the reinforcing layer is integral, the latter layer is always relatively thin, certainly less than 10% and normally from 2–6% of the total thickness. Furthermore, the layer contains no structural steel reinforcement.

Reinforced concrete structural members according to the present invention have increased tensile strength at least at those parts of surface subjected to flexural tensile stresses, giving improved crack-resistance so that surface cracks are eliminated or the onset of cracking under increasing load is delayed, the cracks eventually ensuing being accordingly reduced in width for loads in the normal working range. This also results in improved rigidity performance, showing decreased deformation (e.g. deflection of a beam) in the range of normal, working loads.

In addition, the invention makes it possible to provide a reduced "cover level", this also enabling an increased permissable working load for a given size of member due to the increased moment lever arm of the reinforcing bars. (The "cover level" is the depth of concrete between the internal reinforcement and the surface of the member.)

A significant advantage of the present invention is that it make feasible the use of concrete elements reinforced with higher tensile steel than has hitherto been realisable.

DESCRIPTION OF PREFERRED EMBODIMENTS

The essential features of the invention are illustrated in general terms by, for example, a beam 5m long and having a section of 300mm × 150mm and having an integral reinforcing layer of asbestos fibre reinforced cement extending over the whole of one surface and the immediately adjacent portions of the two adjacent sides. This layer was provided by a pre-formed and consolidated channel of 6mm thick asbestos-reinforced cement composition, having a 150mm wide bottom and 60mm sides, cast integrally with the concrete and its steel reinforcement. The channel formed the bottom part of the shuttering in which the beam was cast, the shuttering being completed by wooden planks overlapping outside the top of the channel sides, the planks being removed after casting. The resulting beam exhibited enhanced rigidity and crack-resisting properties and was capable of a higher design load capacity than a simple reinforced concrete beam of normal construction and similar dimensions.

To further demonstrate the invention, slabs and beams were constructed and tested as illustrated in the accompanying drawings, in which.

Figures 4A, 4B, 4C:
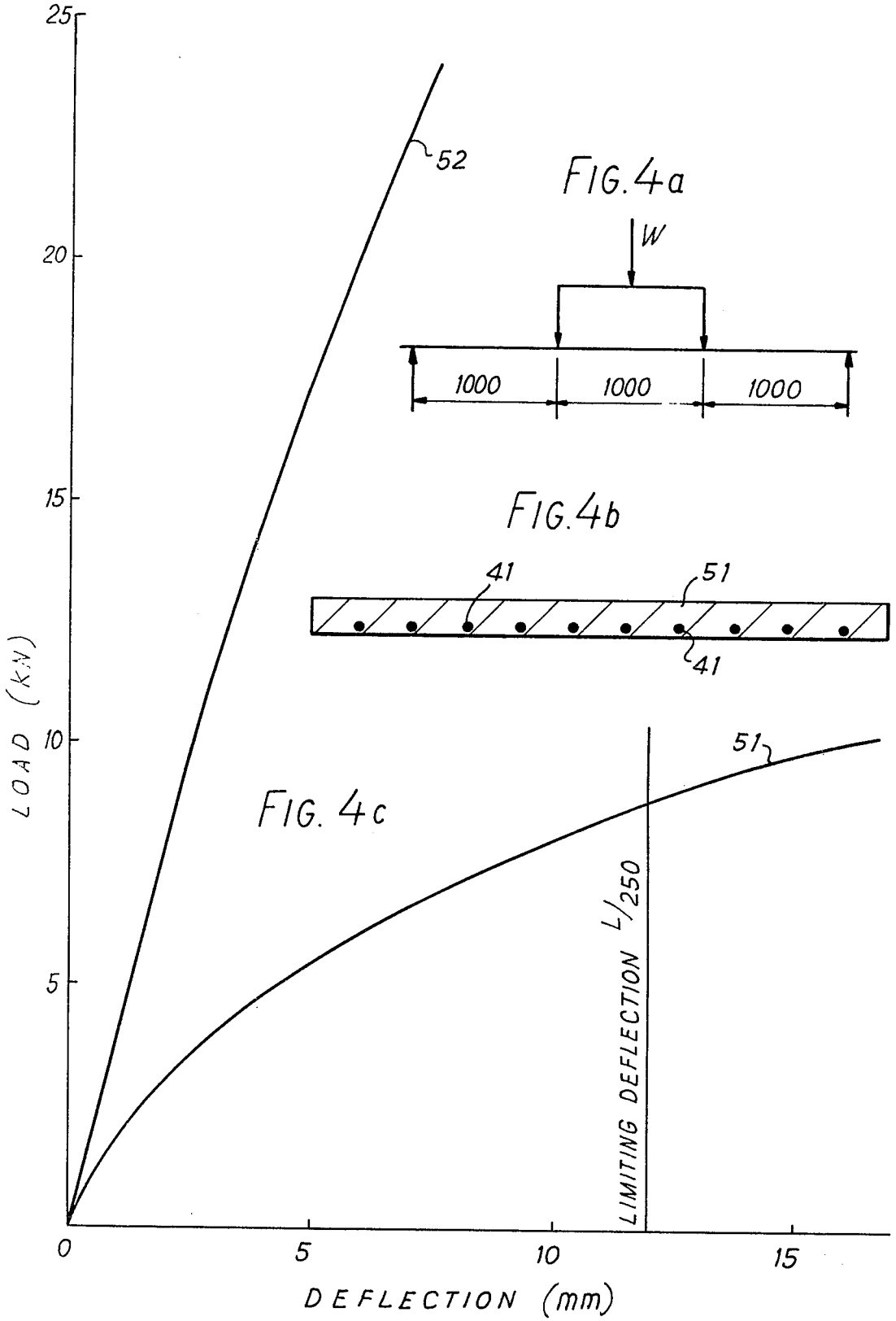
FIG. 4 is a composite figure showing a cross-sectional view (FIG. 4*b*) in a direction normal to the metallic reinforcement through a conventional reinforced concrete slab together with a graph (FIG. 4*c*) comparing the behaviour of said slab under loading (FIG. 4*a*), both when unreinforced and when reinforced according to the invention.
Figures 5A, 5B, 5C:
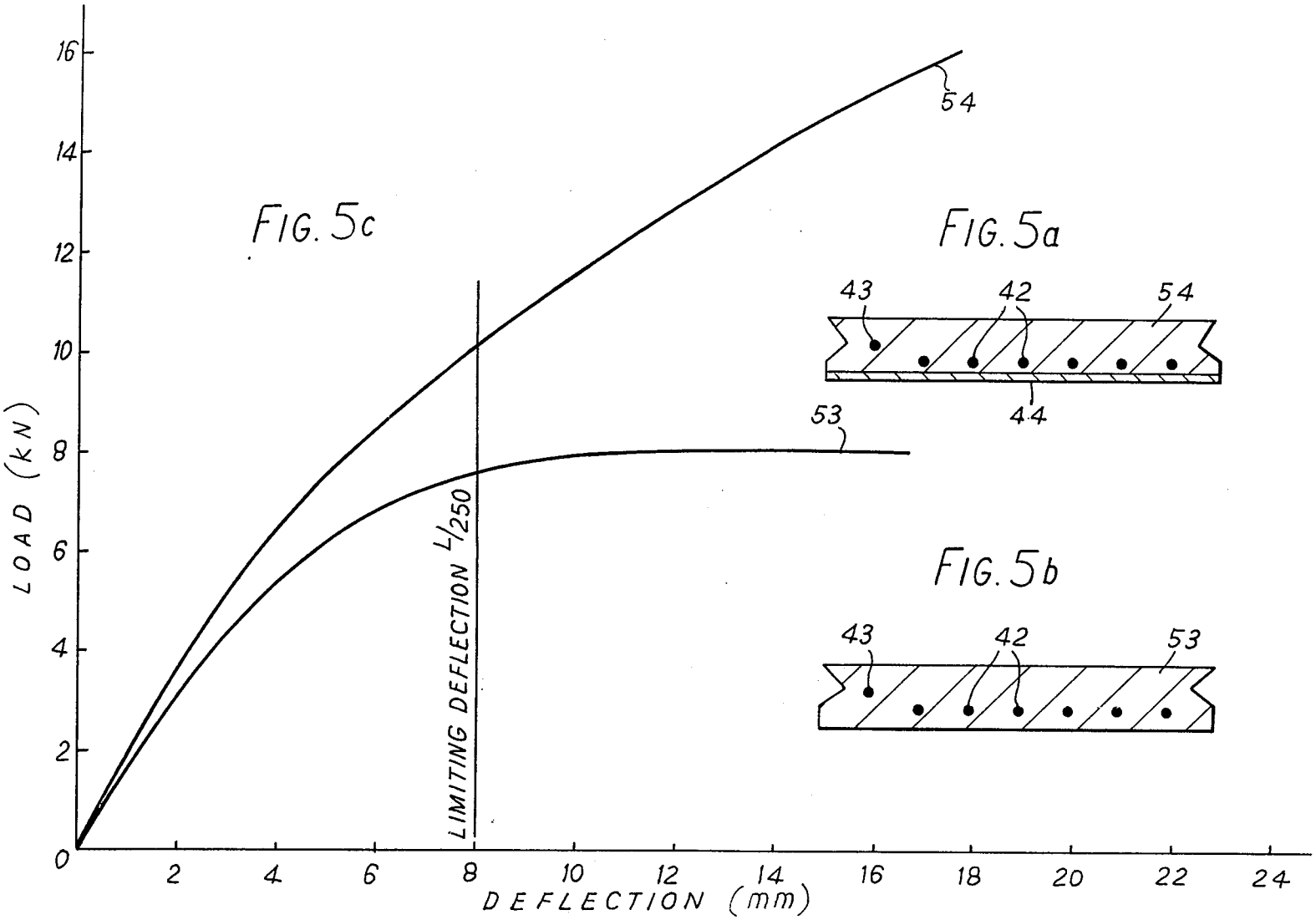

FIG. 5 corresponds to FIG. 4, but shows a different type of slab; reinforced (FIG. 5*a*) and unreinforced (FIG. 5*b*), together with a graph (FIG. 5*c*) showing behaviour under load.

Figure 1:
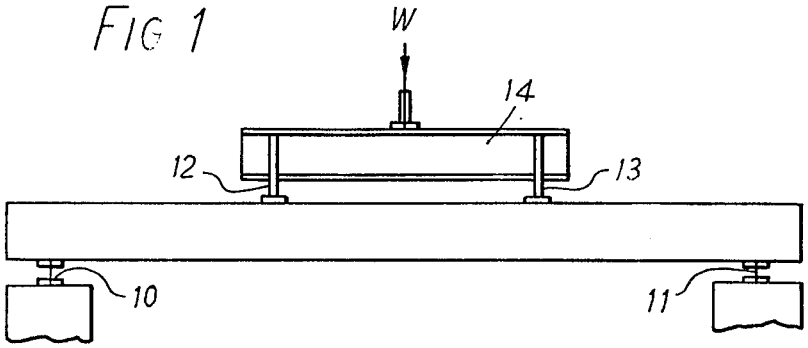
FIG. 1 shows the manner in which a beam was loaded for testing.
Figure 2:
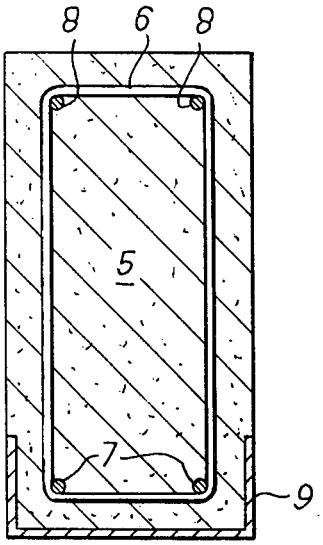
FIG. 2 is a section of a reinforced concrete beam constructed in accordance with the present invention.
Figure 3:
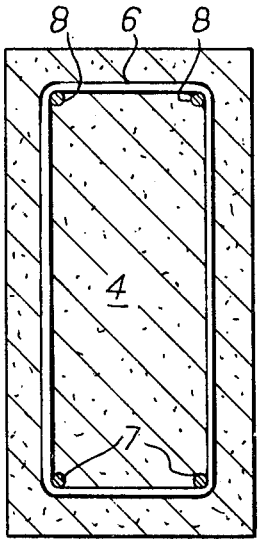
FIG. 3 is a section of a conventional reinforced concrete beam for comparative purposes.
Figures 6A, 6B, 6C, 6D, 6E:
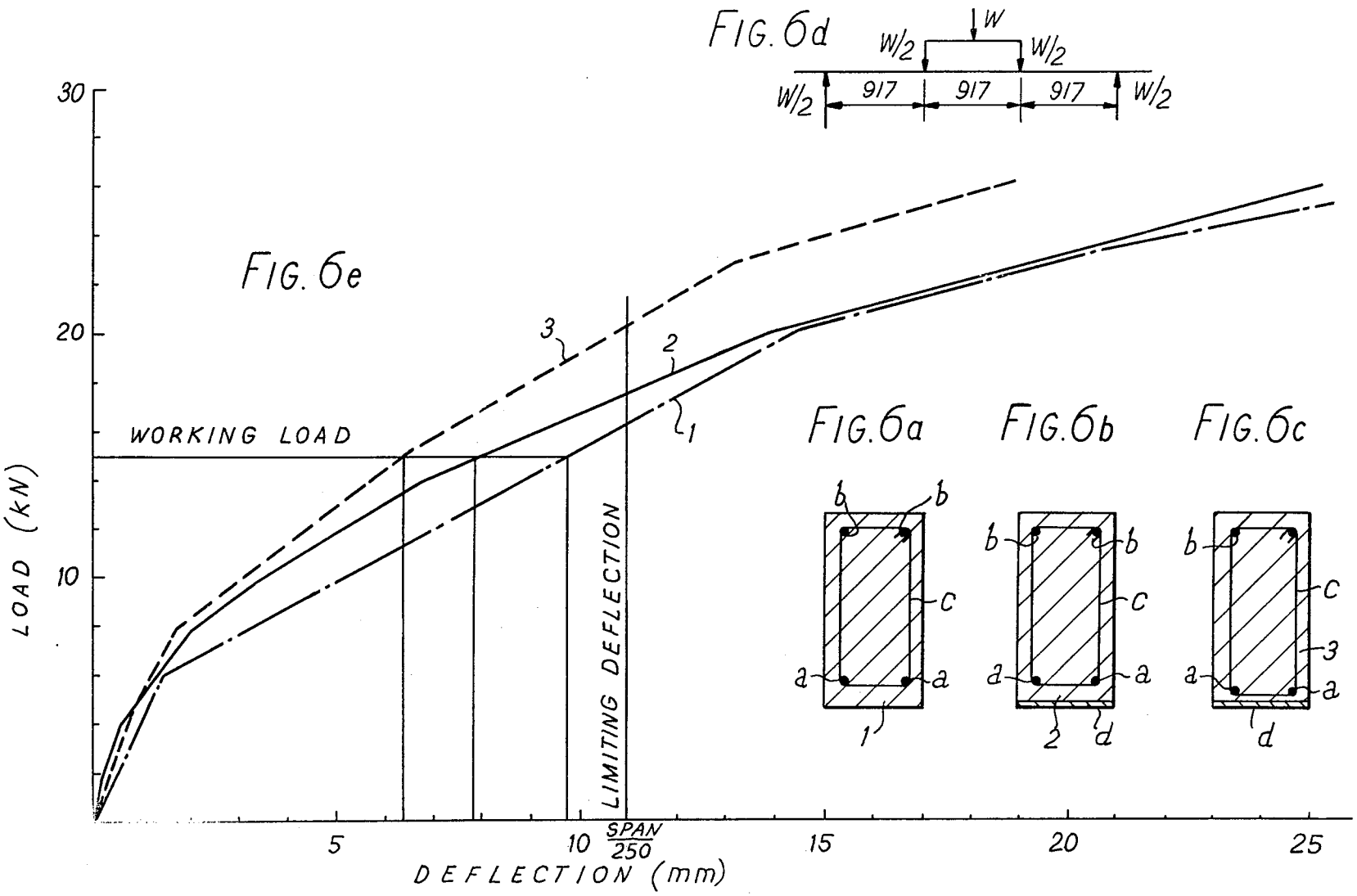
Figures 7A, 7B, 7C, 7D:
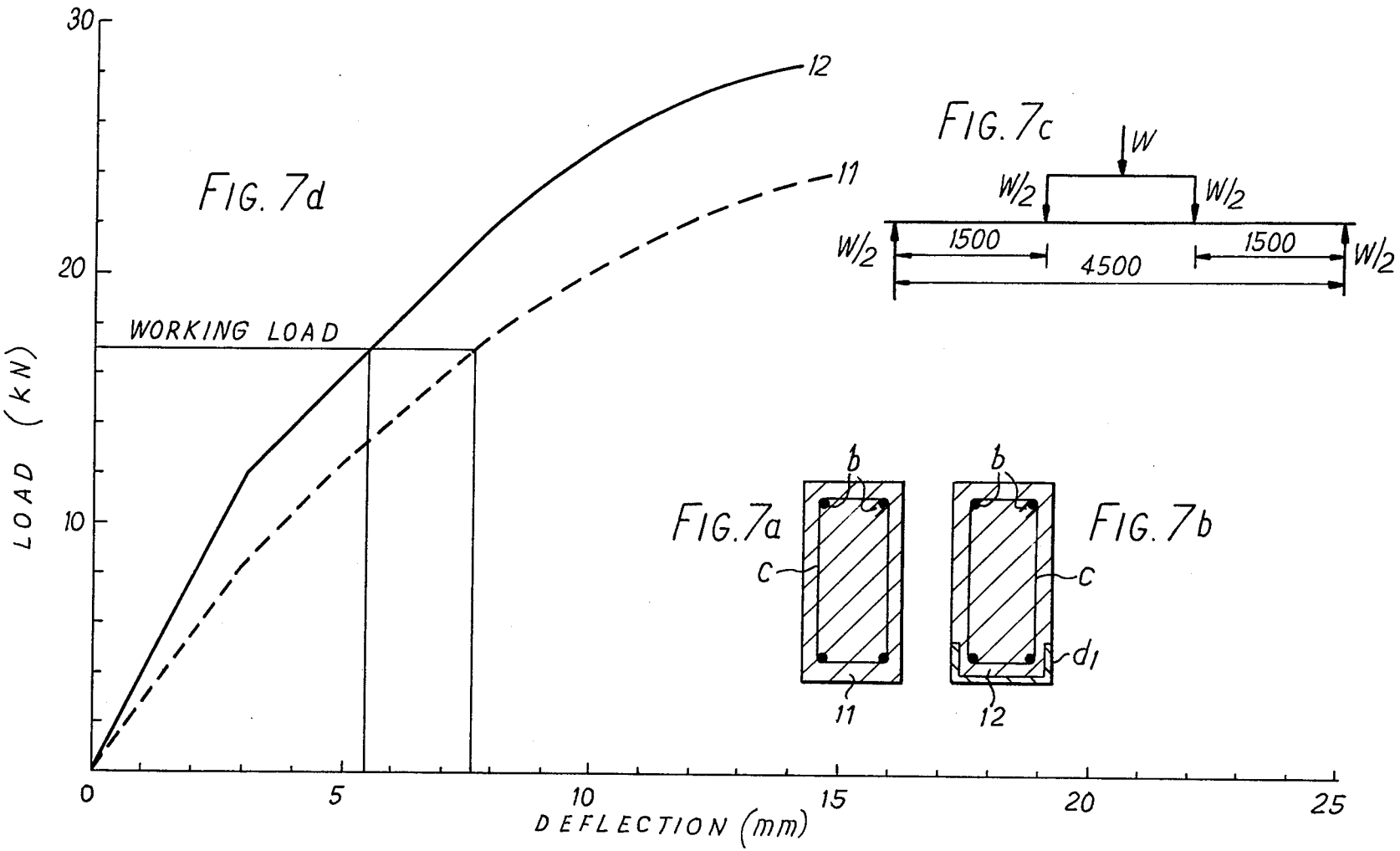
Figures 8A, 8B, 8C, 8D:
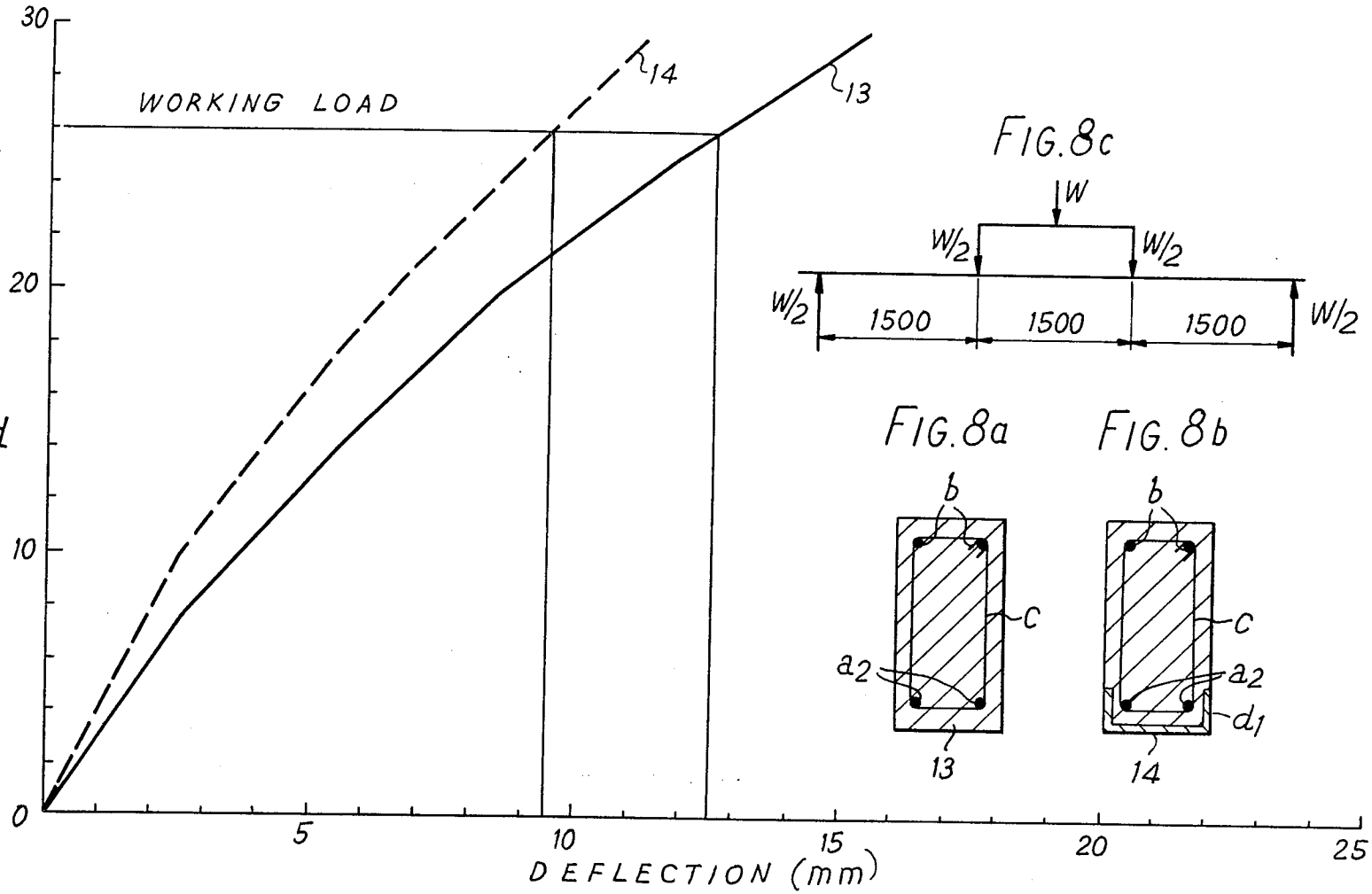
Figures 9A, 9B, 9C, 9D, 9E, 9F, 9G:
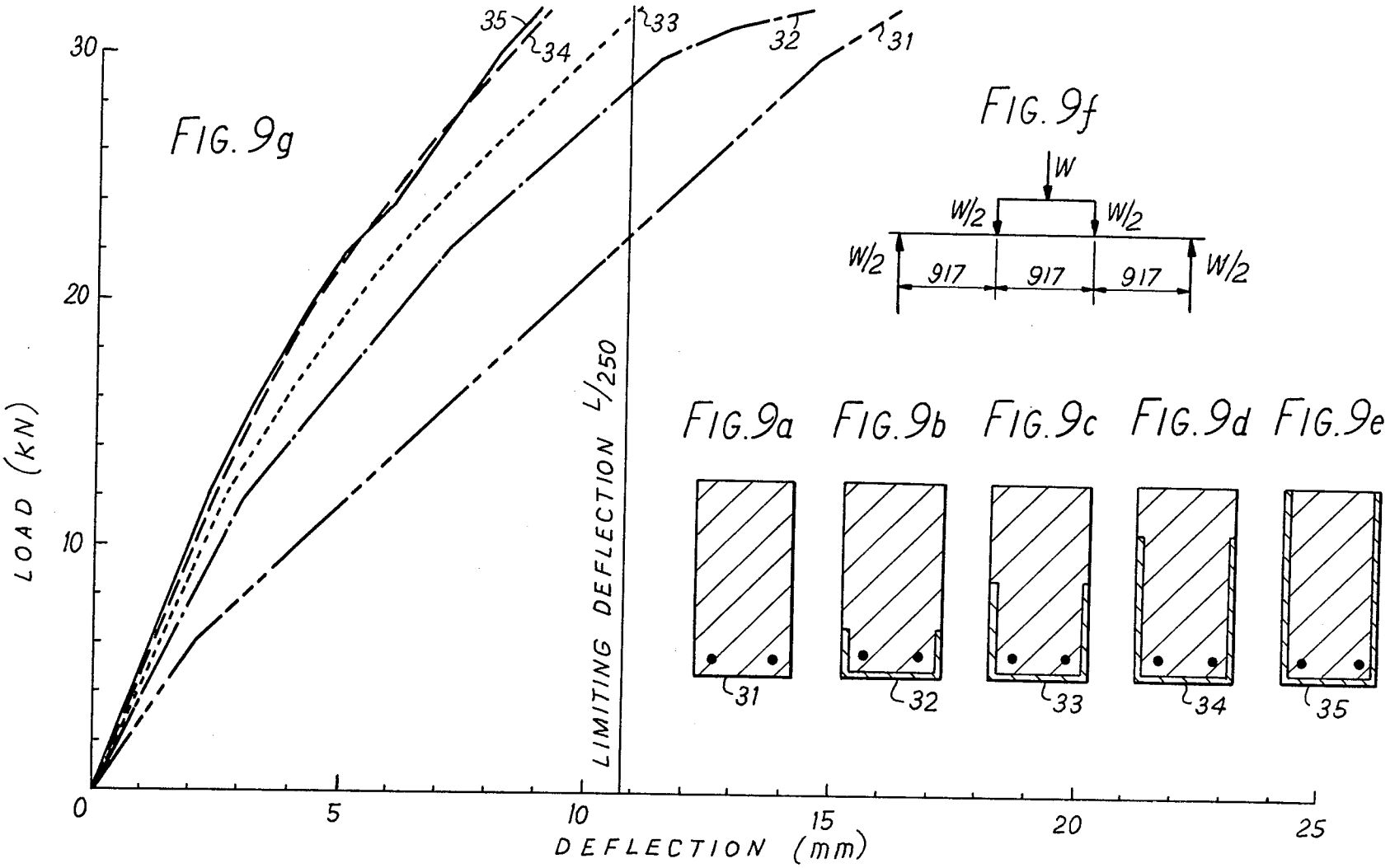
Figures 10A, 10B:
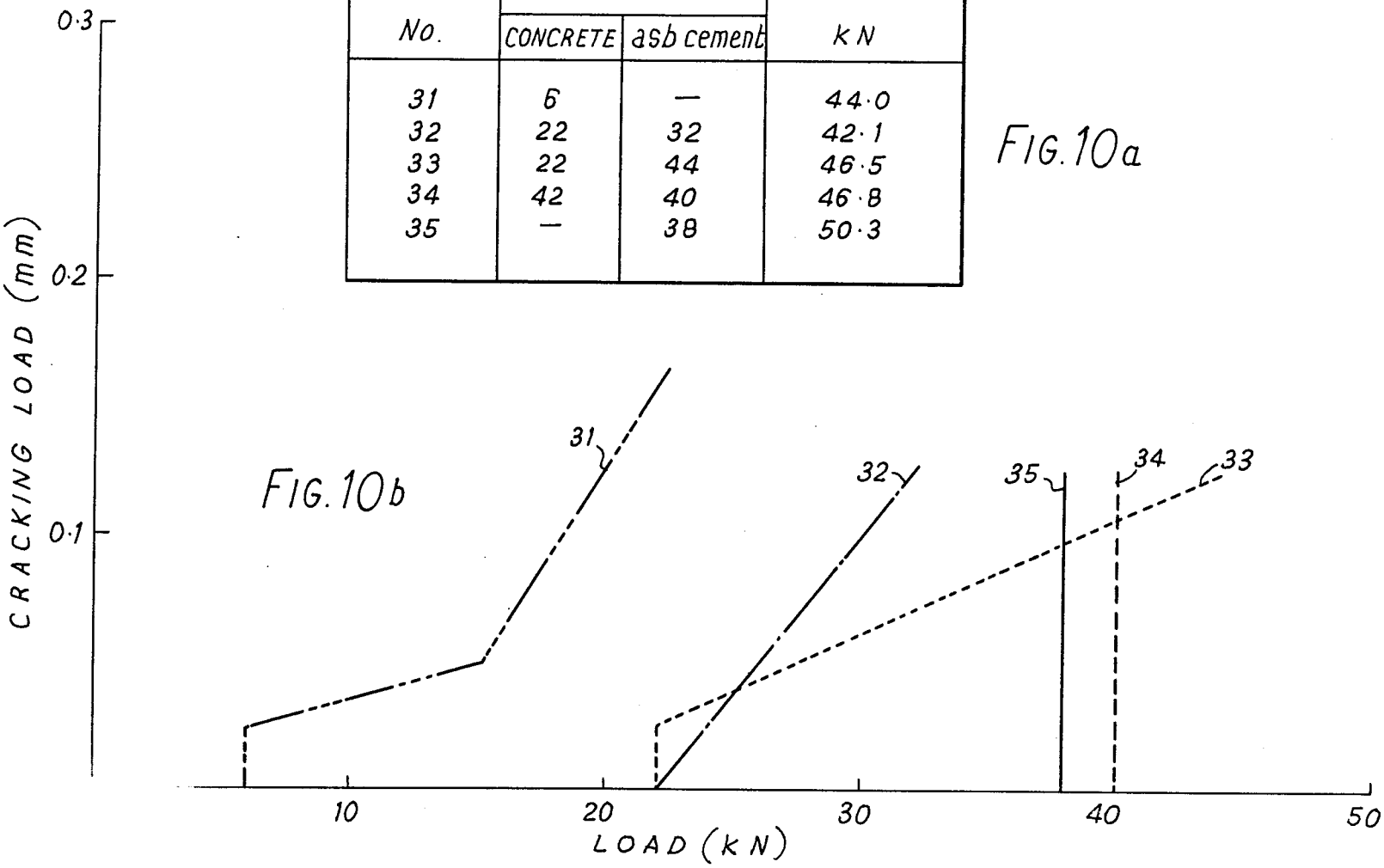

FIG. 6 is a similar composite figure to FIG. 4 and 5, but showing three different beams (FIGS. 6*a*, 6*b*, 6*c*) in cross-section, together with a loading diagram (FIG. 6*d*) demonstrating how the beams were tested and a graph (FIG. 6*e*) comparing the test results;

FIG. 7 is also a composite figure like the others, but showing a pair of beams (FIGS. 7*a*, 7*b*), one reinforced (FIG. 7*b*) according to the invention, the other not (FIG. 7*a*) together with a loading diagram (FIG. 7*c*) and a graph (FIG. 7*d*) showing test results;

FIG. 8 corresponds to FIG. 7, but shows a different pair of beams; (FIGS. 8*a*, 8*b*) a loading diagram (FIG. 8*c*) and a graph showing test results (FIG. 8*d*);

FIG. 9 is another composite figure, this time showing five different beams (FIGS. 9*a*, 9*b*, 9*c*, 9*d* and 9*e*) in cross-section, all without shear transfer stirrups and with only simple bar reinforcement together with a loading diagram (FIG. 9*f*) and a graph showing test results (FIG. 9*g*);

FIG. 10*a* and 10*b* is a load crack width graph for the beams of FIG. 9;

Referring firstly to FIGS. 1–3 inclusive, beams like the one described earlier 5m long and having a section 300mm × 150mm were evaluated. Each beam 4, 5 was provided with two 16mm diameter steel bars 7, as the main reinforcement. Secondary reinforcement bars 8, and shear reinforcement in the form of stirrups 6 were also provided. Concrete made with "Lytag" (Trade Mark) light weight aggregate was used. Beam 5 constructed in accordance with the invention was further provided with an integral reinforcing layer 9 of asbestos fibre-reinforced cement extending over the whole 150mm of one surface and extending 60mm up the adjacent sides of the beam. This layer was provided by a performed channel of asbestos-cement composition, in this case 6mm thick, and with a 150mm wide bottom and 60mm sides, this being cast integrally with the concrete and its steel reinforcing members, in the manner described earlier.

When tested, the beam was supported symmetrically at 4.5m centres by supports 10, 11 and a load W applied symmetrically to the beam at two points 12, 13, which were 1.5m apart, by means of an essentially rigid loading beam 14.

Beams of four constructions were evaluated in this particular exercise:

Beam A1 was a concrete beam reinforced with mild steel and having the section shown in FIG. 3, Beam B1 was a beam reinforced with mild steel and constructed in accordance with the invention, and had the section shown in FIG. 2, being further reinforced with a reinforcing layer formed from 150mm × 60mm asbestos cement channel, Beam A2 was a concrete beam like Beam A1 but reinforced with high tensile steel bars as main reinforcement and Beam B2 was a beam constructed like Beam B1 in accordance with the invention but reinforced with high tensile steel bars as main reinforcement.

DEFLECTION UNDER SHORT TERM LOADING

The design safe working load of Beam A1 was 17.6 kN whereas the load on Beam B1 giving the same deflection as the design load on Beam A1 was 20.8 kN. Again, the design load of Beam A2 was 26.4 kN Beam B2 required a load of 30.4 kN for the same deflection. The increased resistance to bending was very apparent.

SHORT TERM CRACKING BEHAVIOUR

At the design load of 17.6 kN Beam A1 showed a maximum crack width of 0.13mm whereas it required a load of 21.6 kN to produce the same maximum crack width in Beam B1. Again, Beam A2 showed maximum crack width of 0.15mm at its design load of 26.4 kN whereas Beam B2 required a load of 33.8 kN to show the same maximum crack width.

LONG TERM EFFECTS

The above tests were also carried out for a continuous period of 180 days, the results being shown in the following table:

| | | At the End of 180 days | |
|---|---|---|---|
| | Load | Mid-Point Deflection | Average Crack Width |
| Beam A1 | 17.6 kN | 14.4mm | 0.21mm |
| Beam A2 | 17.6 kN | 12.0mm | 0.05mm |
| Beam B1 | 26.4 kN | 26.0mm | 0.20mm |
| Beam B2 | 26.4 kN | 15.0mm | 0.12mm |

The enhanced resistance to cracking was clearly not just a short term effect.

Referring now to the remaining figures, these are all composite figures in which cross-sectional views of several beams (or slabs) are presented together with graphs illustrating their deflection behaviour under various loads applied in accordance with a loading diagram, which is also given in the same figure.

The graphs also include, where appropriate, an indication of the limiting deflection, which is for practical purposes expressed as a given fraction of the span length under test. Conventionally in reinforced concrete design, the limiting deflection is expressed (in millimeters) as:

$$\frac{\text{Span length (mm)}}{250}$$

This the arbitrary figure recommended in the UK Code of Practice 110, for reinforced concrete design, as being appropriate for floors, roofs and all other horizontal members.

In FIG. 4*b*, a cross sectional view of a reinforced concrete slab 51 is given, the slab being 1200 mm wide, and 3000 mm long and 75 mm thick. The reinforcement 41 consisted of ten 8 mm steel bars equally spaced widthwise of the slab and located adjacent the underside thereof. A similar slab 52 (not shown) was also made by casting in situ on top of a 6 mm thick asbestos-cement sheet and the two slabs subjected to loading tests in accordance with the loading diagram of FIG. 4*a*. The slabs will be referred to as 51 and 52, (unreinforced and reinforced according to the invention), respectively.

Two further slabs were made, as shown in FIGS. 5*a* and 5*b* in cross-section at 53 and 54. These slabs were both 400 mm wide, 2000 mm long and 65 mm thick, the reinforcement 42 being six equally spaced parallel 4 mm prestressing wires, located 22 mm from the underside of the slabs and one 4 mm prestressing wire 43 parallel to the others but 39 mm from the underside of the slabs, as shown. The slab 54 (FIG. 5*a*) was cast in situ on a 9mm asbestos cement sheet 44, whilst the other slab 53 (FIG. 5*b*) was exactly as shown, Both slabs were then subjected to loading tests in accordance with FIG. 4*a*, both of course between suitably spaced centers.

The deflection versus load curves for the slabs are plotted in FIGS. 4*c* and 5*c* the curves being identified by the slab numbers. The results are also summarised in Table 1 below:

| Slab Number | 51 | 52 | 53 | 54 |
|---|---|---|---|---|
| Width (mm) | 1200 | 1200 | 400 | 400 |
| Depth (mm) | 75 | 75 | 65 | 65 |
| Tensile surface reinforcement | nil | 6mm | nil | 9mm |
| Steel reinforcement | 10 × 8 mm bars | | 7 × 4mm wires | |
| Slab length (Span)mm | 3000 | 3000 | 2000 | 2000 |
| Ultimate (breaking) load (KN) | 29.6 | 35 | 8.5 | 17.5 |
| Load at a deflection of L/250 (KN) | 8.8 | 31 | 7.7 | 10.3 |

In FIGS. 6*a*, 6*b* and 6*c* three reinforced concrete beams 100mm wide 200 mm deep and 3 meters long are shown in cross-section and identified as 1, 2 and 3 respectively. Beam 1 is reinforced with two 12 mm high yield steel bars (a), two 6mm mild steel bars (b) and a number of spaced-apart (lengthwise of the beam) 6mm mild steel wire stirrups to provide shear transfer, in the usual manner. The bars (a) were covered to a depth of 25 mm by the concrete between them and the underside of the beam. Likewise beam 2 was reinforced as beam 1, but additionally was cast in situ onto a 6 mm sheet (d) of asbestos cement. Beam 3 was the same as beam 2, but the depth of cover between bars (a) and the interface between the concrete and asbestos-cement sheet (d) was minimal. All three beams were loaded as per FIG. 6*d* and the load — deflection curves are plotted in FIG. 6*e*, and identified by the beam numbers 1, 2 and 3, respectively.

The results of testing are tabulated in Table 2 which also includes other test data:

| BEAM NUMBER | 1 | 2 | 3 |
|---|---|---|---|
| Design working load (KN | 15 | 15 | 15 |
| cracking load (concrete)(KN) | 6 | 9 | 10 |
| load at 0.1mm maximum crack width (KN) | 8 | 15.5 | 17.5 |
| Maximum width of crack at design working load (concrete) (mm) | 0.19 | 0.08 | 0.06 |
| Tensile strain at soffit at design working load (mm) | $145\times 10^{-5}$ | $110\times 10^{-5}$ | $110\times 10^{-5}$ |
| Compressive strain at top of beam at design working load | $72\times 10^{-5}$ | $57\times 10^{-5}$ | $54\times 10^{-5}$ |
| Depth of neutral axis from top of beam at design in working load | 56mm | 64mm | 66mm |
| Deflection (a) at design working load (mm) | 9.76 | 7.72 | 6.34 |
| (b) residual deflection after loading (mm) | 1.68 | 1.66 | 1.55 |
| Ultimate (breaking) load (KN) | 28 | 28 | 31 |
| Number of cracks just before failure | 27 | 20 | 17 |
| Depth of neutral axis at | | | |

-continued

| BEAM NUMBER | 1 | 2 | 3 |
|---|---|---|---|
| failure (mm) | 40 | 45 | 54 |
| Concrete cube crushing strength (N/mm$^2$) | 54.7 | 54 | 53 |

FIGS. 7*a* and 7*b* shows a pair of reinforced concrete beams numbered 11 and 12. Both were 150mm wide, 300mm deep and 5 meters long, the steel reinforcement being as in beams 1, 2 and 3 (FIG. 6) except for the bars $^a$1 which were in this case of 16 mm mild steel. The beams only differed in that beam 12 was cast in situ in a 60 mm deep channel of 6 mm thick asbestos-cement, the depth of cover between the bars $^a$1 and the bottom of the beam being adjusted so as to make the total cover depth for each beam the same, 35 mm. A second pair of beams, 13 and 14 are shown in FIGS. 8*a* and 8*b*, the only difference between this pair and beams 11 and 12 being the use of high yield strength 16 mm steel bars, $^a$2 instead of mild steel. Otherwise the beams were the same, 13 unreinforced (on the tensile surface) and 14 surface reinforced according to the invention, with a 60 mm deep 6 mm asbestos cement channel.

The concrete used for these tests used lightweight aggregate.

The beams were loaded in accordance with FIG. 7*c* or 8*c* and the deflection-load curves are plotted in FIGS. 7*d* & 8*d*, the individual curves being identified by beam number. The test results are also set out below in Table 3.

| BEAM NUMBER | 11 | 12 | 13 | 14 |
|---|---|---|---|---|
| Design working load (KN) | 17 | 17 | 26 | 26 |
| Cracking load (concrete) (KN) | 4 | 16 | 8 | 18 |
| Load corresponding to 0.1mm maximum crack width (KN) | 12 | 22 | 18 | 30 |
| Cracking load (asbestos cement channels)(KN) | nil | 22 | nil | 34 |
| CRACKING AT DESIGN WORKING LOAD | | | | |
| (a) crackwidth at 60mm above soffit - maximum width (mm) | 0.13 | 0.03 | 0.14 | 0.08 |
| - average width (mm) | 0.08 | 0.02 | 0.12 | 0.05 |
| Number of cracks | 12 | 6 | 13 | 5 |
| (b) Crack width at soffit - maximum (mm) | 0.15 | 0 | 0.18 | 30 |
| - average | 0.09 | 0 | 0.11 | 0 |
| Number of cracks | 13 | 0 | 14 | 0 |
| DEFLECTION | | | | |
| At working load (mm) | 7.6 | 5.4 | 12.5 | 9.5 |
| Residual deflection after loading (mm) | 2.0 | 1.22 | 2.39 | 1.82 |
| Ultimate load (KN) | 52 | 54 | 61 | 62 |
| Concrete cube crushing strength (N/mm$^2$) | 53.1 | 54.2 | 52 | 52 |

FIGS. 9*a* through 9*e* show in cross-section five reinforced concrete beams, numbered 31 through 35.

They were all 100 mm wide, 200 mm deep and 3 meters long internally reinforced with a pair of 12 mm high yield steel bars located close to the bottom of each beam. Surface reinforcements of asbestos cement channel 9 mm thick were provided for beams 32 through 35, the channel depth being 50, 100, 150 and 200 mm respectively. No shear transfer stirrups were employed in any of these five beams.

Loading was applied to each beam in accordance with FIG. 9*f* and the load — deflection curves plotted and identified in FIG. 9*g* by beam number. The crack width — load relationship is plotted in FIG. 10, also by beam number.

The results are set out in Table 4 below:

| BEAM NUMBER | 31 | 32 | 33 | 34 | 35 |
|---|---|---|---|---|---|
| 1. Design working load (KN) | 15 | 15 | 15 | 15 | 15 |
| 2. Cracking load (concrete) (KN) | 6 | 22 | 22 | 42 | not applicable |
| (asbestos cement)(KN) | nil | 32 | 44 | 40 | 38 |
| 3. Load at 0.1mm | 18.4 | 30 | 38.4 | 40 | 38 |
| 4. Max. width of crack at design working load (mm) | 0.05 | nil | nil | nil | nil |
| 5. Tensile strain at soffit at design working load ($\times 10^{-5}$) | 113 | 46 | 34 | 34 | 36 |
| 6. Compressive strain at top of beam ($\times 10^{-5}$) | 63 | 52 | 42 | 36 | 34 |
| 7. Depth of neutral axis from top of design working load (mm) | 64 | 68 | 97 | 102 | 90 |
| 8. Deflection (mm) | | | | | |
| (a) at design working load | 6.76 | 4.22 | 3.48 | 3.08 | 3.19 |
| (b) residual after loading | 1.84 | 0.84 | 0.54 | 0.39 | 0.41 |
| 9. Ultimater (breaking) load (KN) | 44 | 42.1 | 46.5 | 46.8 | 50.3 |
| 10. No of cracks just before failure | 11 | 6 | 5 | 4 | 4 |
| 11. concrete cube crushing strength ($N/mm^2$) | 43.2 | 41.1 | 45.7 | 40.1 | 41.9 |

The foregoing results illustrate the fact that there is nothing to be gained by extending the surface reinforcement beyond the neutral axis of the beam. The improvement, if any, is marginal and, compared with the improvement already achieved by the preferred degree of reinforcement, is not justifiable.

It should be noted that in the foregoing tables and Figures, the references to "cracking load (concrete)" and "cracking load (asbestos cement)" relate to the load required to develop cracking in the concrete of the beam and in the asbestos-cement surface reinforcement, respectively. Cracking in the concrete can of course only be observed above the surface reinforcement where the latter is in the preferred channel configuration. The properties of the surface reinforcement itself were discussed earlier in the present Specification, ultimate tensile strengths (for asbestos cement) in the range 16–20 $N/mm^2$ (compared to 1.5–3.5 for concrete alone) being typical. Likewise, tensile strains at breaking of the order of 600–1600($x10^{-6}$), compared with 100–200($x10^{-6}$) for concrete alone are typical.

Whilst the foregoing discussion explicitly refers to asbestos and glass fibers, it will be appreciated that the invention may also be practised with other fibers having a high modulus, for example steel fibers. It will also be appreciated that in the case of glass fibers, the risk of alkaline attack on the glass by the cement matrix must be considered; for example, alkali-resistant glass fibers may be used or the glass fibers may be coated to protect them from lime released during hardening of the cement.

It will be appreciated that in evaluating the foregoing experimental results for the purpose of comparison between beams and reinforcement, it is necessary to make due allowance for variations in, for example, the cube crushing strength of the various concrete mixes employed.

Thus on the basis of a comparison between beams 1, 2 and 3 of FIG. 6 the advantages of the invention are readily apparent. However a direct comparison with another beam such as beams 30 through 35 in FIG. 9 must make allowance for the appreciable difference in cube crushing strength of the concrete mix concerned, the precise details of the internal reinforcement being less significant. Also in comparing the examples, it is important to note that although the differences between say, an externally unreinforced beam and one externally reinforced only on the tensile face, may appear relatively modest, the progressive improvement achieved by also reinforcing the sides of the beam towards and finally up to the neutral axis, is very considerable indeed, representing a dramatic improvement in behaviour under loadings which would rapidly destroy an externally unreinforced beam. Also, this dramatic improvement is achieved by using a thin reinforcing layer-constituting significantly less than 10% of the total thickness of the beam or slab. Moreover the layer contains no structural steel reinforcement at all.

I claim:

1. A method of reinforcing a reinforced concrete structural element having a tensile reinforcing member therein adjacent one surface portion to resist tensile stresses developed in said surface portion under a working load, the method comprising the steps of covering and fixedly joining to said one surface portion an external reinforcing layer of a cement composition incorporating reinforcing fibres disposed in the layer in a random two-dimensional distribution.

2. The method of claim 1 together with the step of applying a working load to said structural element to produce a tensile stress in said one surface portion.

3. A method of manufacturing a structure incorporating a reinforced concrete structural element which in use will have at least part of one surface thereof subject to tensile stresses, the method including the steps of casting said element including a tensile reinforcing member adjacent said one surface to resist tensile stress developed in said one surface integrally with a preformed external reinforcing layer of a cement composition containing reinforcing fibres disposed in the layer with their major axes lying substantially parallel to the surface of the layer in otherwise random orientation, selecting the location and dimensions of said layer so that it covers only that part of the one surface which in use will be subject to tensile stresses, and incorporating said element into the structure so that said part of said one surface is subject to tensile stresses.

4. A method according to claim 3 for manufacturing a reinforced concrete structural element wherein the dimensions of the reinforcing layer are selected so that the reinforcing layer covers the full width and extends over the whole length of the surface subject to tensile stresses.

5. A method according to claim 4 wherein the reinforcing layer also extends to cover such parts of the sides of the element adjacent the surface which are subject to tensile stresses.

6. A method according to claim 3 wherein the reinforcing layer also extends to cover such parts of the sides of the element adjacent the surface which are subject to tensile stresses.

7. A method according to claim 3 including the step of casting the element integrally with a plurality of the preformed external laterally spaced apart reinforcing layers of a cement composition containing reinforcing fibres disposed in the layer with the major axes of the fibres lying substantially parallel to the surface of the layer in otherwise random orientation, the location and dimensions of each of the layers being selected so that the layers cover only those parts of the surface which in use will be subject to tensile stresses.

8. A method according to claim 3 including the step of also casting the element integrally with a further preformed external reinforcing layer of a cement composition containing reinforcing fibres disposed in the layer with the major axes of the fibres being substantially parallel to the surface of the layer in otherwise random orientation, the location and dimensions of said further layer being selected so that it covers only that part of the opposite surface to the one surface and which in use will also be subject to tensile stresses.

9. A method according to claim 8 including the step of casting the element integrally with a plurality of said further layers, the location and dimensions of which are selected so that they cover only those parts of said opposite surface which in use will also be subject to tensile stresses.

10. The method of claim 3 wherein the reinforcing layer is performed and is formed to be relatively this as compared to the total depth of said structural element.

* * * * *